United States Patent [19]

Brown, Jr. et al.

[11] Patent Number: 4,630,781

[45] Date of Patent: Dec. 23, 1986

[54] APPARATUS AND METHOD FOR REMOVING CRUSHING ROLLS FROM A CRUSHING APPARATUS

[75] Inventors: Donald W. Brown, Jr., St. Louis, Mo.; Mark L. Kohler, Waterloo, Ill.

[73] Assignee: T.J. Gundlach Machine Company, Belleville, Ill.

[21] Appl. No.: 629,656

[22] Filed: Jul. 11, 1984

[51] Int. Cl.[4] ..... B02C 4/28

[52] U.S. Cl. ..... 241/159; 29/426.3; 72/239; 241/285 A; 241/235

[58] Field of Search ..... 29/426.3, 244, 426.2, 29/267, 426.1, 402.03, 402.04, 700, 822, 823, 824; 241/285 R, 30, 285 A, 227–236, 159; 72/236, 237, 238, 239, 210

[56] References Cited

U.S. PATENT DOCUMENTS

| | | | |
|---|---|---|---|
| 2,539,775 | 1/1951 | Gordon | 241/285 A |
| 3,881,663 | 5/1975 | Brown | 241/230 X |
| 4,275,580 | 6/1981 | Hayes | 72/239 |

*Primary Examiner*—Mark Rosenbaum

*Attorney, Agent, or Firm*—Cohn, Powell & Hind

[57] ABSTRACT

An apparatus and method for removing crushing rolls from a crushing apparatus is disclosed in which arms means mounted on a movable frame supporting movable crushing rolls which move with the movable frame are utilized to remove stationary crushing rolls mounted on a stationary supporting frame to a position at which the stationary rolls may be lifted from the crushing apparatus. With the stationary and movable frames adjacent to each other, the arm means are placed in supporting engagement with the stationary crushing rolls mounted on the stationary frame. The crushing rolls mounted on the stationary frame are then released from its support so that the stationary crushing rolls are supported by the arm means. The movable frame is then moved away from the stationary frame to move the stationary crushing rolls supported by the arm means to a position at which the stationary crushing rolls may be lifted from the arm means.

13 Claims, 7 Drawing Figures

APPARATUS AND METHOD FOR REMOVING CRUSHING ROLLS FROM A CRUSHING APPARATUS

FIELD OF THE INVENTION

This invention relates to an apparatus and method for removing crushing rolls from a crushing apparatus and, more particularly, to an apparatus and method for removing crushing rolls that are stationarily mounted in the crushing apparatus utilizing a movable frame also carrying movable crushing rolls.

BACKGROUND OF THE INVENTION

Large crushing plants typically have an overhead feed structure which dumps material to be crushed onto crushing rolls located below the feed structure. The crushing rolls are preferably supported by a stationary framework which assures the ability to withstand the forces involved in the crushing of large pieces of material such as stone and coal. On the other hand, accessibility to and movability of the crushing rolls to inspect and remove them for maintenance purposes is also necessary.

As a result of the need for removal of the crushing rolls, various compromise arrangements between stationary and movable mounting of the crushing rolls have been used in commercial installations. In one common type of such crusher construction, the crushing rolls on one side of the crushing apparatus are mounted on a stationary frame and the crushing rolls on the other side are mounted on a movable frame and are therefore referred to as movable rolls. During normal crushing operation, the movable crushing rolls on the movable frame are positioned adjacent the stationarily mounted rolls. To remove the movable crushing rolls from the crushing plant, the movable frame is moved away from the stationary frame and out from beneath the overhead feed structure. This permits access to the crushing rolls carried on the movable frame and their removal by a suitable hoist. The stationary rolls may be detached from their support and moved through the space resulting from the movement of the movable frame to a position where the stationary rolls may also be lifted and removed by a hoist. However, a serious drawback of this crushing apparatus is that it is very difficult to move the stationary rolls, which may weigh two to three tons, underneath the overhead feed structure to a position where they can be lifted and removed.

It is accordingly a general object of this invention to provide a crushing roll removal apparatus and method which eliminates the aforesaid difficulty and permits relatively easy and quick removal of stationary crushing rolls in a crushing plant.

SUMMARY OF THE INVENTION

The invention provides a roll crushing apparatus having first and second support means positioned adjacent to each other and respectively supporting first and second crushing rolls positioned with their axes parallel to each other. The first roll may be stationarily mounted although it is releasable from the first support means. The second roll is supported at a crushing position adjacent the first roll and may be considered as movable. The second support means is movable away from the first support means to move the second crushing roll to a position spaced from the first support means. A roll removal means is mounted on the second support means for supporting the first crushing roll upon release of the first roll from the first support means. When the second support means moves away from the first support means, a roll removal means carries the first roll to a position spaced from the first support means. At the positions of the first and second crushing rolls spaced from the first support means, access may be had to the two rolls for their repair or lifting from the crushing apparatus.

The roll removal means includes a pair of arm means which are spaced apart and which engage the first crushing roll along its length to provide carrying support. Each means comprises a first and second arm mounted on the second support means. The two arms may be removable from the support means. The first arm extends into engagement with the first crushing roll. The second arm is disposed in a partially vertical position and is connected to the first arm to provide support for carrying the first crushing roll.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
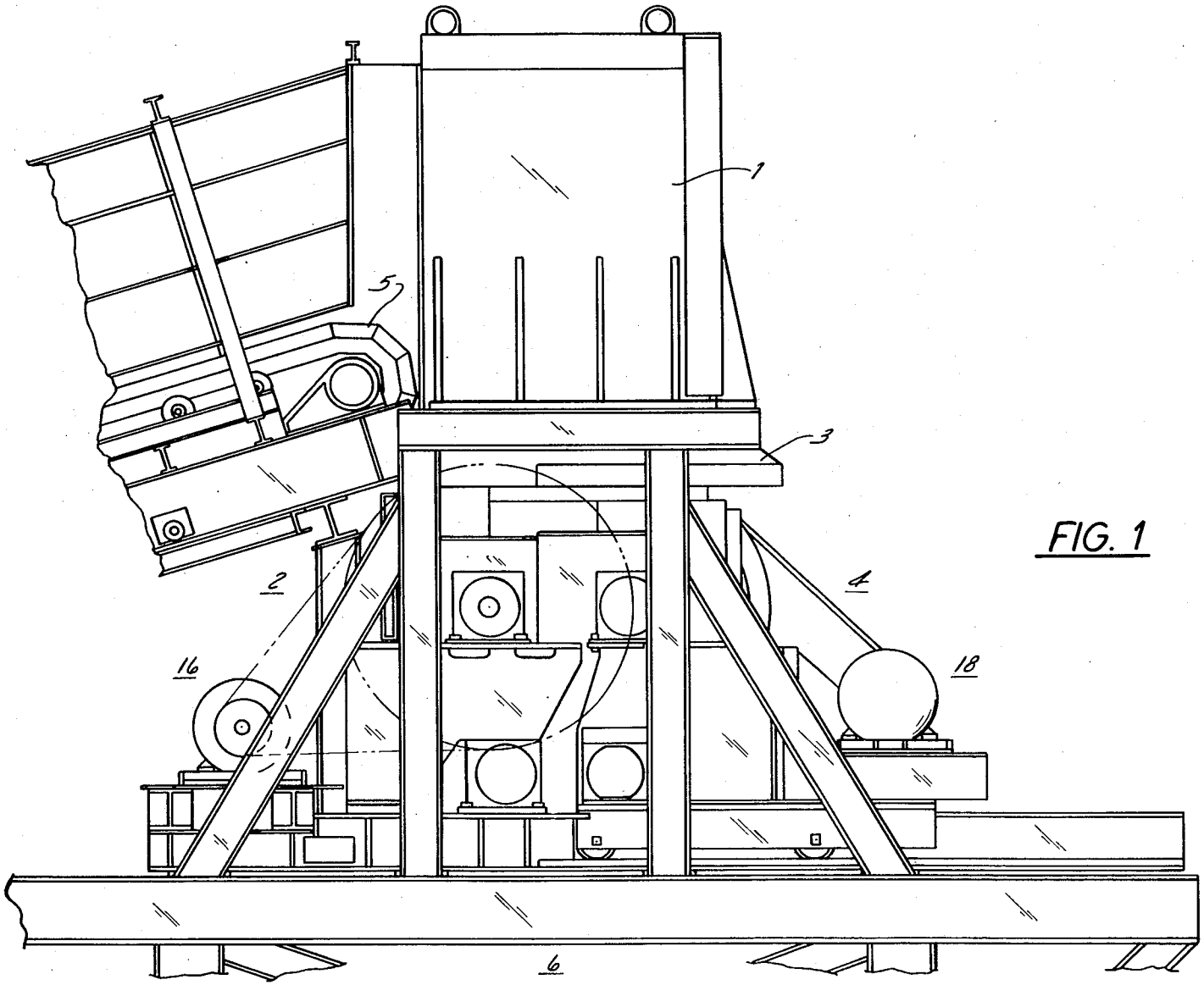
FIG. 1 is a side elevation view of a crushing apparatus in a closed, crushing position, and a conveyor for feeding material to be crushed to the crushing apparatus.
Figure 2:
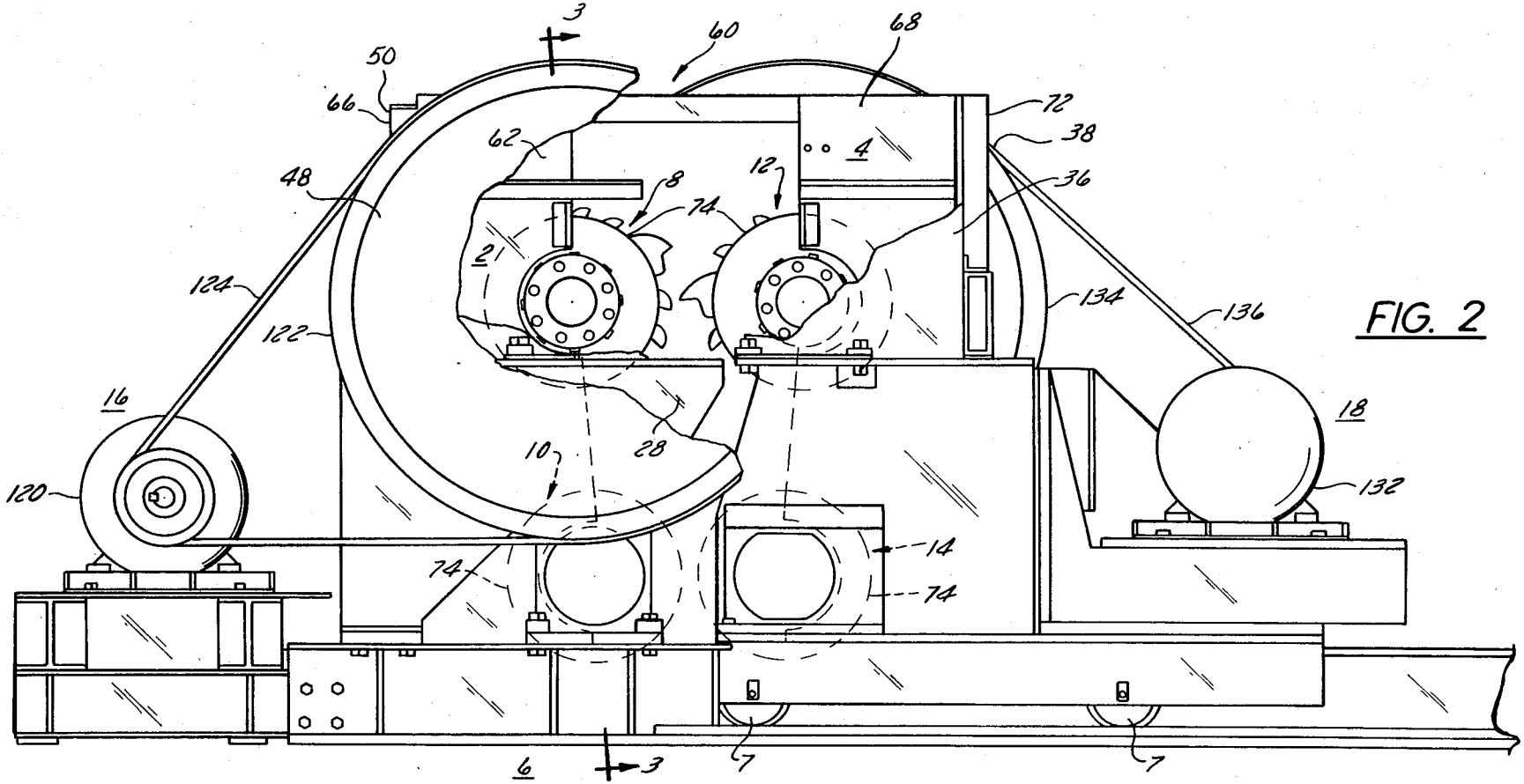
FIG. 2 is a side elevation view, partially broken away, of the crushing apparatus of FIG. 1 in a closed, crushing position with parts removed to illustrate the crushing rolls.

Referring generally to FIGS. 1 and 2, a roll crushing apparatus is shown as having an overhead feed chute, a stationary supporting frame 2, a movable support frame 4, and a base frame 6. A hood 3 is mounted on the feed chute 1 above the stationary and movable support frames 2 and 4. A conveyor 5 is positioned to feed material to be crushed into the feed chute 1. The stationary support frame 2 is bolted or otherwise immovably attached to the base frame 6. The movable support frame 4 is movable on rollers 7 on the base frame 6 in directions toward and away from the stationary support frame 2. Upper and lower stationary crushing rolls 8 and 10 are supported on and held by the stationary support frame 2. Similarly, upper and lower movable crushing rolls 12 and 14 are supported on and held by the movable support frame 4. The axial lengths of all four crushing rolls are disposed in a parallel relationship. Roll drive means 16 is provided for the upper and lower stationary crushing rolls 8 and 10 and roll drive means 18, mounted on the movable support frame 4, is provided for the upper and lower movable crushing rolls 12 and 14.

The movable support frame 4 includes support members 20 and 22 respectively positioned adjacent each end of the upper movable crushing roll 12 for supporting the roll 12. The lower movable crushing roll 14 is supported adjacent each of its ends on beams 24 and 26 of the movable support frame 4. The stationary support frame 2 includes support members 28 and 30 which respectively are positioned adjacent opposite ends of the upper stationary crushing roll 8 and support the roll 8. The lower stationary crushing roll 10 is supported adjacent its opposite ends on beams 32 and 34 of the base frame 6. The movable support frame 4 also includse covers 36 and 38 respectively positioned adjacent opposite ends of the movable crushing rolls 12 and 14. The stationary support frame 2 includes covers 48 and 50 positioned adjacent opposite ends of the stationary rolls 8 and 10. The covers 36, 38, 48 and 50 enclose parts of the drive means 16 and 18.

A hopper 60 is formed by the stationary support frame 2 and movable support frame 4 when they are in their closed position, as shown in FIGS. 1 and 2. The hopper 60 comprises side walls 62 and 64 and an end wall 66, all part of the stationary support frame 2, and side walls 68 and 70 and an end wall 72, as part of the movable support frame 4. In the closed position of the crushing apparatus, the side walls 62 and 64 overlap somewhat with the side walls 68 and 70 to form a relatively tight enclosure for containment of material being crushed.

The crushing rolls 8, 10, 12 and 14 each include a cylindrical housing 74, a plurality of crushing teeth 75 extending from the housing, and a hub 76 at each of their ends. The lower stationary crushing roll 10, the lower movable crushing roll 14, and the ends of the upper stationary roll 8 and upper movable crushing roll 12 which are not driven, each have stub shafts 80 which are journaled in bearing blocks 84 The driven ends of the upper stationary crushing roll 8 and the upper movable crushing roll 12 each have drive shafts 102 journaled in bearing blocks 106. The bearing blocks 84 for the lower stationary crushing roll 10 are respectively mounted on beams 32 and 34 of the base frame 6 and the bearing blocks 84 and 86 for the lower movable crushing roll 14 are mounted on beams 24 and 26 of the movable support frame 4. The bearing block 106 of the upper stationary crushing roll 8 is mounted on support member 28 of frame 2 and the bearing block 106 of the upper movable crushing roll 12 as mounted on support member 22 of frame 4. Each of the hubs 76 includes a plurality of reinforcing gussets 88 and a flange 90 facing either a stub shaft 80 or a drive shaft 102. The flanges of the hubs 76 and therefore the rolls of which the hubs and flanges are a part are bolted by means of a plurality of bolts 94 and nuts 96 to the shafts which they face.

The drive means 16 for the stationary rolls 8 and 10 includes a motor 120 mounted on the base frame 6, a flywheel 122 affixed to the end of the drive shaft 102 of roll 8, and a plurality of drive belts 124 connecting the motor and the flywheel to provide a rotary driving motion to the upper stationary crushing roll 8. The drive means 16 also includes a sprocket wheel 126 bolted by the bolts 94 and nuts 96 to the drive shaft 102, a sprocket wheel 128 bolted to the stub shaft 80 of lower stationary roll 10 by the bolts 94 and nuts 96, and a drive chain 130 connecting the two sprocket wheels 126 and 128. Through the drive chain 130, the motor 120 also provides rotary drive motion to the lower stationary crushing roll 10. Similarly to the drive means 16 for the stationary rolls, the drive means 18 for the movable rolls includes a motor 32 mounted on the movable support frame 4, a flywheel 134 affixed to the drive shaft 102 of the upper movable crushing roll 12, and a plurality of drive belts 136 connecting the motor 132 and the flywheel 134. Through the drive belts 136, the motor 132 provides rotating motion to the upper movable crushing roll 12. The drive means 18 also includes a sprocket wheel 138 affixed to the drive shaft 102 of the upper movable crushing roll 12 by bolts 94 and nuts 96 and a sprocket wheel 140 affixed to the stub shaft 80 of the lower movable crushing roll 14 by bolts 94 and nuts 96, and a drive chain 142 connecting the sprocket wheel 138 and 140. Through the drive chain 142, the motor 132 provides rotating motion to the lower movable crushing roll 14.

During operation, the crushing apparatus is in its closed position, as shown in FIGS. 1 and 2, with the drive means 16 rotating the upper and lower stationary crushing rolls 8 and 10 in a clockwise direction relative to the views of FIGS. 1 and 2 and the drive means 18 rotating the upper and lower movable crushing rolls 15 and 16 in counterclockwise direction relative to the views of FIGS. 1 and 2. Material to be crushed, for example, limestone or coal, is fed from the conveyor 5 through the feed chute 1 into the hopper 60. The material moves from the hopper 60 between the movable rolls due to gravity and also due to the movement towards each other of the teeth on the rolls 8 and 12 and 10 and 14. Following the crushing of the material between the rolls, it passes out of the bottom of the crushing apparatus to a discharge conveyor means (not shown). The larger spacing and larger teeth of the upper crushing rolls results in crushing of large pieces to a medium size and the smaller spacing between the lower crushing rolls will accept the medium crushed pieces and will further crush the material to a smaller size. If the rolls are damaged during operation or the teeth become deteriorated, the movable crushing rolls may be moved away from the stationary crushing rolls to an access position for inspection and removal by movement of the movable support frame 4 away from the stationary support frame 2 to an access position as shown in FIG. 5.

Figure 3:
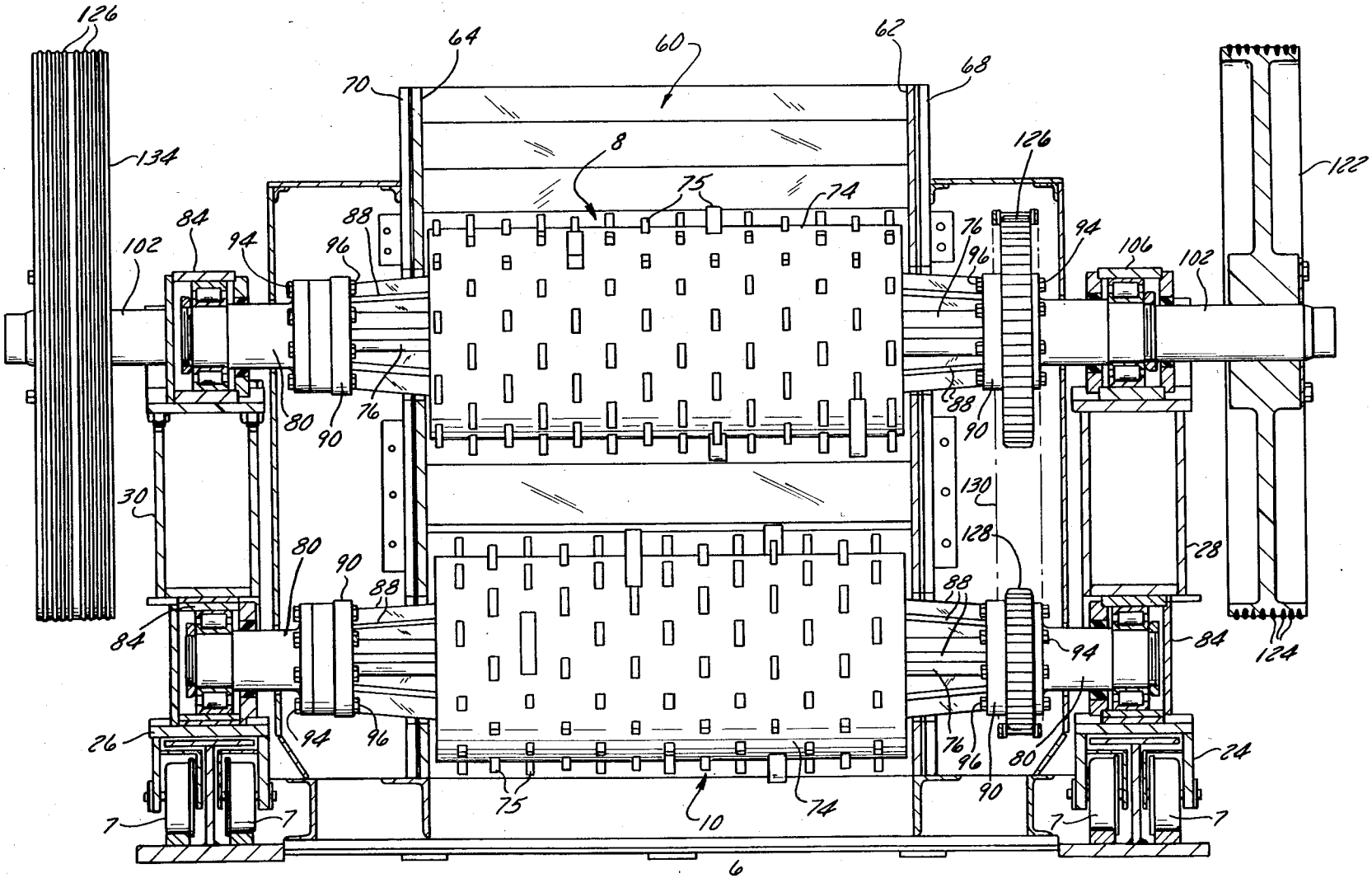
FIG. 3 is an end view, partly in section along the lines 3—3 of FIG. 2 and with certain components removed, showing the roll removal apparatus in a position supporting the stationary rolls just prior to removal of the stationary rolls.
Figure 7:
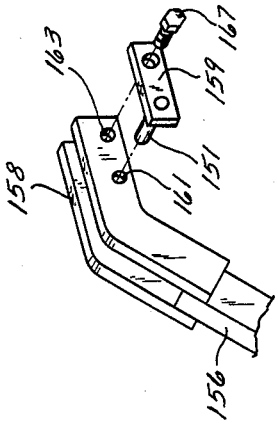
FIG. 7 is a perspective view of a locking pin for attaching the roll removal apparatus to the crushing apparatus.
Figure 4:
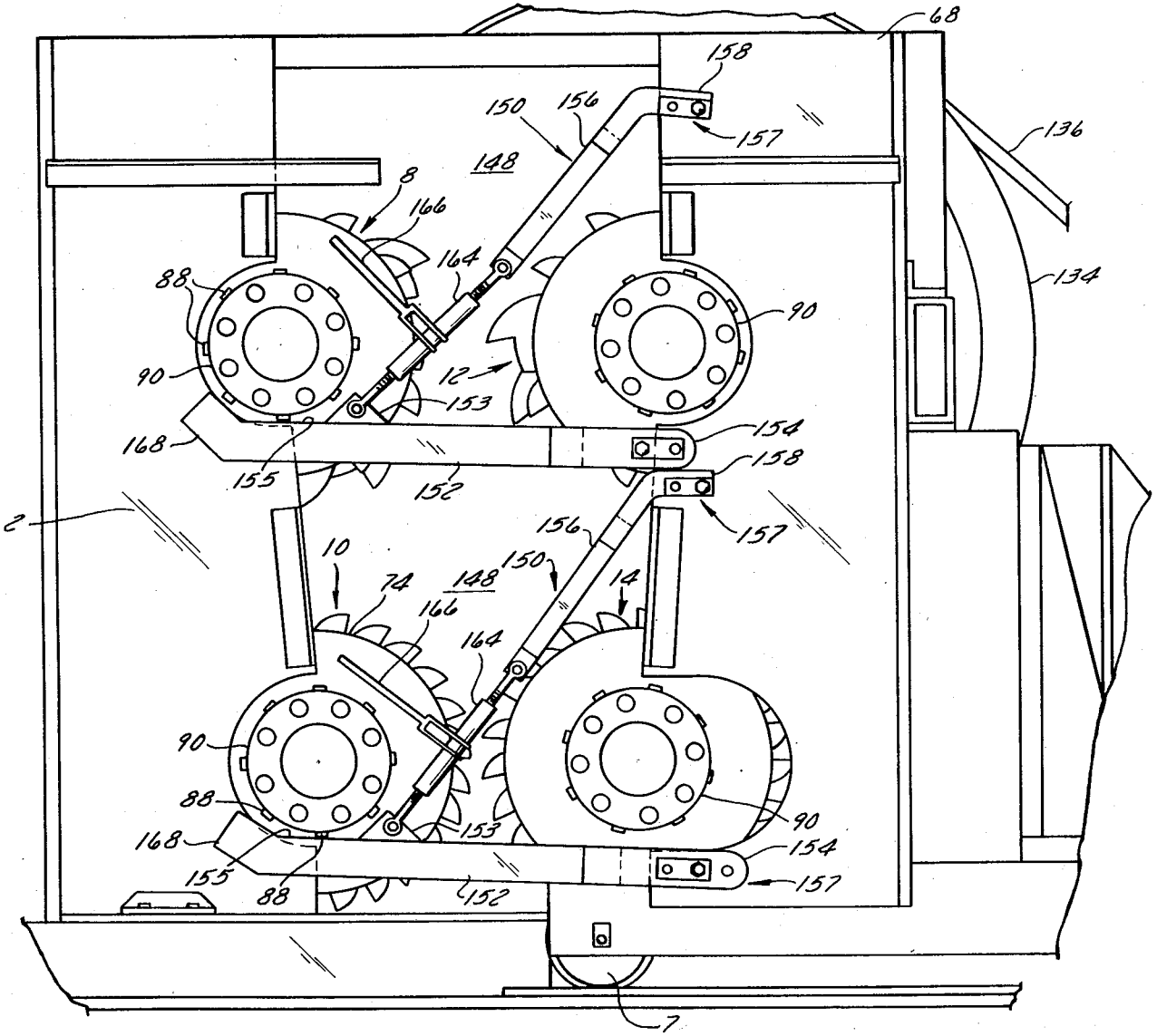
FIG. 4 is a side elevation view of the crushing apparatus illustrated in FIG. 2 in a closed position with certain components removed to illustrate the roll removal apparatus of the invention.
Figure 5:
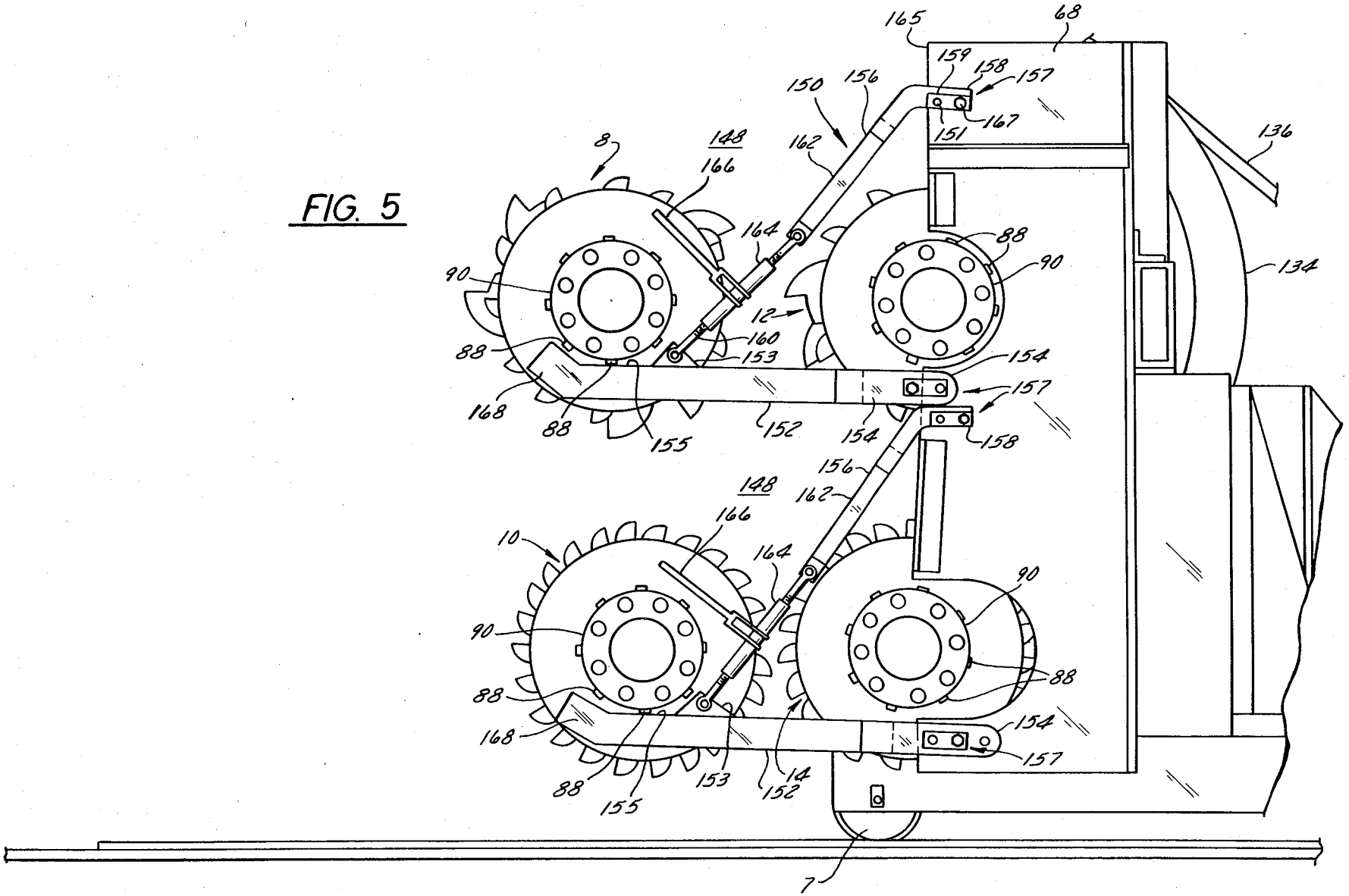
FIG. 5 is a side elevation view of the crushing apparatus as shown in FIG. 4 in an open position with the roll removal apparatus holding the stationary crushing rolls.
Figure 6:
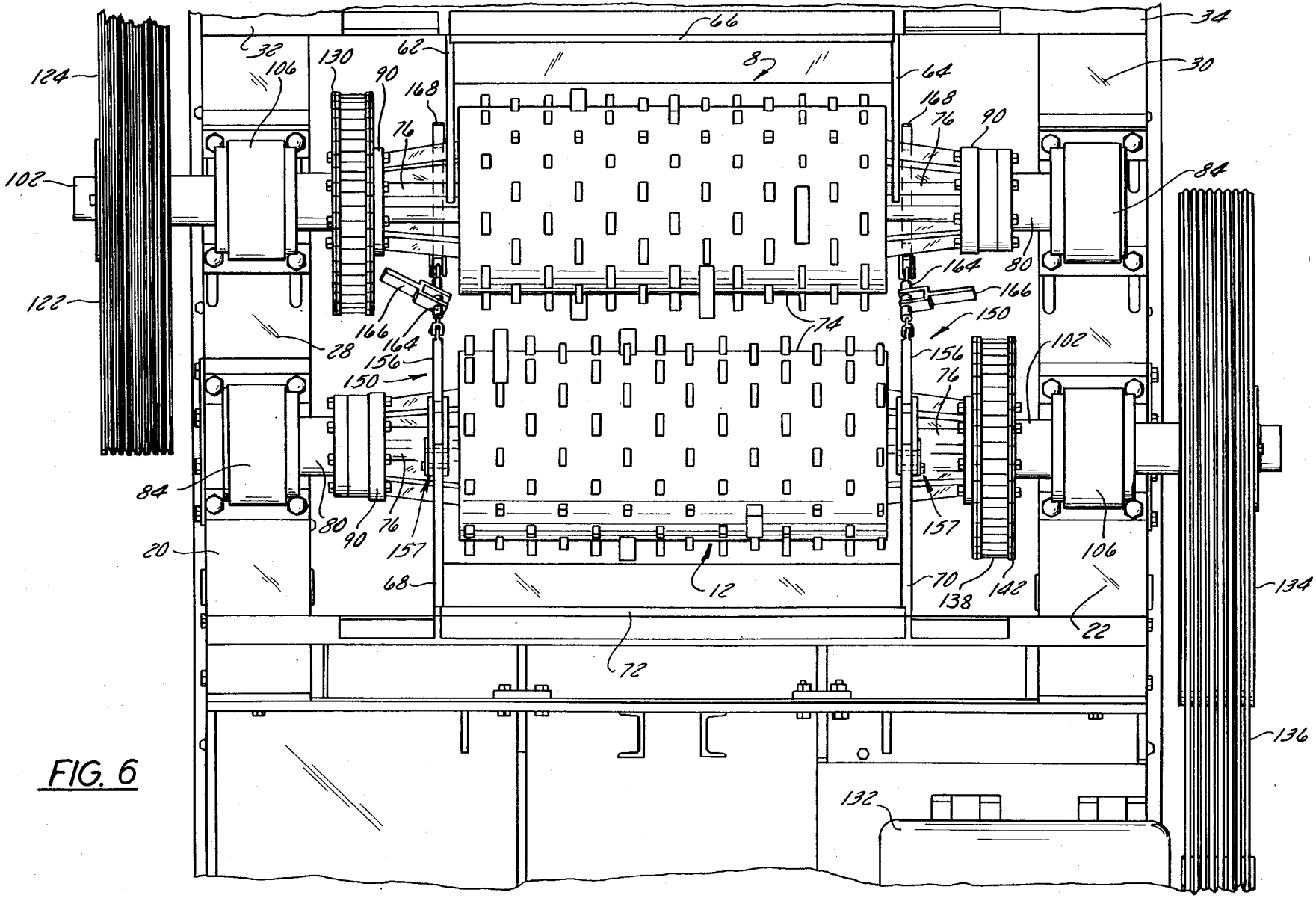
FIG. 6 is a plan view showing the roll removal apparatus and the crushing rolls in their position as illustrated in FIG. 4.

With reference to FIGS. 3, 4, and 5, a roll removal means 148 is illustrated for each of the stationary crushing rolls 8 and 10 to be removed from the stationary support frame 2. Each roll removal means 148 comprises first and second arm means 150 respectively positioned preferably adjacent opposite ends of the crushing roll they are to remove. Each arm means 150 adjacent each end of a stationary crushing roll and adjacent the ends of the upper and lower crushing rolls are identical and consequently only one of the arm means 150 for removal of the upper stationary roll 8 will be described in detail. The arm means 150 includes a lower arm 152 having a bifurcated end 154 connected to the hopper sidewall 68 of movable support frame 4 and an upper arm 156 having a bifurcated end 158 also connected to the hopper sidewall 68 of movable support frame 4. The bifurcated ends 154 and 158 of the respective arms 152 and 156 are each connected to the hopper wall 68 by means of a locking pin 157 having a plate 159 engaging one of the bifurcated end sections, a pin 151 extending through the bifurcated ends 154 and 158 and through a hole in the wall 68, and a bolt 167 extending through the plate 159 and threaded into a threaded hole 163 in the bifurcated end section engaged by the plate 159. The lower end 160 of the upper arm 156 is connected to a tab 153 on the lower arm 152 and at a location on the lower arm 152 intermediate the position of engagement of the lower arm 152 with the upper stationary crushing roll 8 and the connection of the lower arm 152 with the hopper sidewall 68. The upper arm 156 includes a solid member 162 and a turn buckle member 164 having a handle 166. The turn buckle 166 is pinned to the tab 153 of the lower arm 152 and the solid member 162 of the upper arm 156. The lower arm 152 includes an upturned end 168 which, together with the upwardly extending tab 153, form a recess 155 in which the lower arm 152 supports and holds the upper stationary crushing roll 8.

Although the arm means 150 for the upper and lower stationary crushing rolls 8 and 10 are essentially identical to each other, the arm means 150 for the lower stationary roll is mounted at a slightly different angle on the sidewall 68 of the hopper 60 than the mounting angle of the arm means 150 for the roll 8. As can be seen in FIGS. 4 and 5, the lower arm 152 supporting the roll 8 is connected to the wall 68 at a location closer to the edge 165 of the wall 68 than the connection to the wall 68 of the lower arm 152 supporting the roll 18. Also the upper arm 156 supporting the roll 8 is mounted on the wall 68 such that it has a slightly more horizontal position than the upper arm 156 supporting the roll 10.

The procedure for removing one or both of the stationary crushing rolls 8 and 10 from the support of the stationary support frame 2 includes the positioning of the movable support frame 4 adjacent the stationary support frame 2 such that the crushing apparatus is closed and the positioning of an arm means 150 in engagement with the crushing roll to be removed adjacent each of its ends, as shown in FIGS. 3 and 4. In order to so position each arm means 150, certain parts of the crushing apparatus must be removed to provide the necessary access to the stationary crushing rolls 8 and 10. FIGS. 4 and 5 illustrate the crushing apparatus with the cover 36 of the movable support frame 4 and the cover 48 of the stationary support frame 4 removed. The resulting access to the stationary crushing rolls 8 and 10 permits the connecting of an arm means 150 to each of the hopper walls 68 and 70 of the movable support frame 4. As the arm means 150 are connected to the hopper walls, the lower support arms 152 of each arm means 150 are positioned beneath the hubs 76 and 78 at the ends of the stationary crushing rolls 8 and 10. The end 154 of lower arm 152 and the end 158 of upper arm 156 may then be secured to the hopper walls 68 and 70 utilizing the locking pin 157. At this point, the turn buckles 164 should be at a length sufficient to permit the securing of the arms 152 and 156 to the hopper walls 68 and 70 without placing any load on each of the arm means 150. The turn buckles 164 are then turned to pivot the lower and upper arms 152 and 156 about pins 151 and thereby bring the lower arms 152 up into firm engagement with the hubs 76 at each end of the stationary crushing rolls 8 and 10. The hubs 76 and thereby the stationary crushing rolls 8 and 10 may now be removed from the support of the stationary support frame 2 by removing the bolts 94 from the hubs 76. The movable support frame 4 may now be moved away from the stationary support frame 2 to remove the rolls to a position, as shown in FIG. 5, out from underneath the feed chute 1 and hood 3 to permit the inspection or repair of the rolls 8 and 10. The stationary rolls as well as the movable rolls are now in a position at which they may be lifted away from the crushing apparatus by the use of an appropriate hoist.

An apparatus and method has been disclosed with which the crushing rolls of a crushing apparatus, which are normally fixed in position and to which access is quite difficult, can be easily removed and lifted from the apparatus for their repair. In the preferred embodiment of the invention, the roll removal means adds no structure to the crushing apparatus and may be detached from the crushing apparatus for use in removing rolls of other crushers.

It will be understood that the foregoing description of the present invention is for purposes of illustration only and that the invention is susceptible to a number of modifications or changes, none of which entail any departure from the spirit and scope of the present invention as defined in the hereto appended claims. For example, the vertical arm of the arm means may be oriented such that it is positioned below the horizontal arm and extends upward to provide load carrying support. Also, the arm means may be incorporated into the movable support frame of the crushing apparatus as an integral, permanent part of the apparatus.

What is claimed is:

1. In a roll crushing apparatus having first and second rotatable crushing rolls disposed with their axial lengths parallel, the combination comprising:

first means for supporting and holding the first crushing roll to permit rotation of said roll, the first crushing roll being releasable from the first means;

second means movable in a direction away from the first means for supporting the second crushing roll at a crushing position adjacent the first roll and the first means, and moving the second crushing roll from said crushing position to a position spaced from the first means for greater accessibility to said rolls;

roll removal means removably mounted on the second means for supporting the first crushing roll upon release of the latter from the first means and carrying the first crushing roll to a position spaced from the first means as the roll removal means moves with the second means;

said roll removal means comprising a pair of arm means, one of the arm means being engageable with the first crusher roll and the other of the arm means being engageable with the first roll at a position spaced from the one arm means along the axial length of the first roll;

said arm means comprising a first arm connected to the second means and extendable into engagement with the first crushing roll and a second arm connected to the first arm and the second means; and said arm means being constructed and arranged to be mounted to said second means primarily during the roll removal process.

2. The apparatus according to claim 1, wherein each arm means comprises a first arm mounted on the second means and engaging the first crusher roll and a second arm mounted on the second means and connected to the first arm, the second arm extending in a partially vertical direction whereby it provides support to the first arm for carrying the first crushing roll.

3. The apparatus according to claim 2, wherein each second arm extends upward from a first arm.

4. The apparatus according to claim 3, wherein each second arm is connected to the first arm intermediate the locations of the engagement of the first arm with the first crusher roll and the connection of the first arm with the second means.

5. The apparatus according to claim 1, 2, 3 or 4 wherein the second arm has an adjustable length.

6. The apparatus according to claim 5 wherein the first and second arms are each pivotally connected to the second means, the first arm pivotally moving upward about the second means in response to length shortening adjustment of the second arm whereby the first arm moves into engagement with the first crushing roll.

7. The apparatus according to claim 5 wherein the first arm has an end and a recess in the end, positionable beneath and engageable with the first crushing roll.

8. The apparatus according to claim 7 wherein said recess comprises, on the first arm, an upturned end and an upwardly projecting tab spaced from the upturned end.

9. In a roll crusher having first and second rotatable crushing rolls horizontally juxtaposed with axial lengths parallel and a hopper for directing material to be crushed between the crushing rolls, the combination comprising:

a stationary frame, the first roll being releasably supported on the stationary frame;

a movable frame, the second roll being supported on the movable frame, the movable frame being movable between a crushing position adjacent to the stationary frame and a roll removal position spaced from the stationary frame; and a pair of roll removal and support devices, each of which comprises a first support arm having a free end and an end attached to the movable frame, a second support arm disposed at least partially vertically and connected to the first support arm and to the movable frame, and having means for elevating the free end of the first support arm, the first support arm having a position in supporting engagement with the first roll upon release of the latter from the stationary frame, whereby the first and second support arms move with the movable frame and second roll to the roll removal position and carry the first roll to, and hold the first roll at the roll removal position for ready inspection and maintenance, as well as for removal of both rolls from the crusher.

10. In a roll crusher having a first pair of crushing rolls disposed one above the other with their axial lengths parallel, a second pair of crushing rolls disposed one above the other with their axial lengths parallel, the two pairs of rolls being positioned in a crushing position adjacent and opposite each other and forming a passageway through which material being crushed by the rolls passes, and hopper means for directing material to be crushed into the passageway between the roll pairs, the combination comprising:

a stationary frame, positioned beneath the hopper means, the first pair of crushing rolls being mounted on the stationary frame beneath the hopper means;

a movable frame positioned beneath the hopper means, the second pair of crushing rolls being mounted on the movable frame beneath the hopper means, the movable frame being movable together with the second pair of rolls from beneath the hopper means to a position at which both pairs of rolls are accessible;

a first roll support arm at each end of each of the first pair of crushing rolls and connected to a second roll support arm vertically positioned intermediate the location of the engagement of the first roll support arm with the first crushing roll and the location of the connection of the roll support arm with the movable frame, each of the first pair of crushing rolls being releasable from its mounting and from the stationary frame, each of said first roll support arms being in supporting engagement with an end of a first crushing roll upon said release of the roll, whereby the first roll support and second vertical arms carry the first pair of crushing rolls from beneath the hopper means when the movable frame moves to the accessible position to provide ready access to the rolls for inspection and maintenance.

11. In a method for removing a stationary rotatable crushing roll from a crusher having the stationary crushing roll mounted beneath a hopper on a stationary frame and a movable rotatable crushing roll mounted beneath the hopper on a frame movable between a crushing position in which material from the hopper is fed between the rolls and a roll access position spaced from the crushing position, the steps comprising:

supporting a roll support means on the movable frame with the latter in the crushing position;

moving the roll support means into engagement with the stationary crushing roll permitting support of the stationary crushing roll by the roll support means;

releasing the stationary crushing roll from the stationary frame and transferring support of the stationary crushing roll to the roll support means;

moving the movable frame together with the movable crushing roll and the stationary crushing roll to the roll access position.

12. The method in accord with claim 11, wherein the step of moving the roll support means into engagement with the stationary crushing roll is accomplished by extending the roll support means from the movable frame into engagement with a lower side of each end of the stationary roll.

13. The method in accord with claim 12, wherein the step of transferring support of the stationary roll to the roll support means includes adjusting the position of the roll support means upward at the area of engagement of the latter with the roll.

* * * * *